US011703292B2

(12) United States Patent
Muska

(10) Patent No.: US 11,703,292 B2
(45) **Date of Patent: *Jul. 18, 2023**

(54) FIREARM HAVING RECIPROCABLE BREECH COVER

(71) Applicant: Smith & Wesson Inc., Springfield, MA (US)

(72) Inventor: Simon M. Muska, Enfield, CT (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/713,265

(22) Filed: Apr. 5, 2022

(65) Prior Publication Data

US 2022/0228825 A1 Jul. 21, 2022

Related U.S. Application Data

(62) Division of application No. 16/924,537, filed on Jul. 9, 2020, now Pat. No. 11,326,845.

(60) Provisional application No. 62/885,837, filed on Aug. 13, 2019.

(51) Int. Cl.

| | |
|---|---|
| ***F41A 9/00*** | (2006.01) |
| ***F41A 3/66*** | (2006.01) |
| ***F41A 15/12*** | (2006.01) |
| ***F41C 23/04*** | (2006.01) |
| ***F41C 7/02*** | (2006.01) |

(52) U.S. Cl.

CPC ..... *F41A 3/66* (2013.01); *F41A 15/12* (2013.01); *F41C 7/02* (2013.01); *F41C 23/04* (2013.01)

(58) Field of Classification Search

CPC .. F41A 3/66; F41A 15/12; F41A 15/16; F41A 19/09; F41A 9/37; F41A 9/72; F41A 11/02; F41C 7/02; F41C 7/00; F41C 23/04; F41C 23/16; F41C 23/20; F41C 7/025

USPC ..... 42/71.01–75.1, 16

See application file for complete search history.

(56) References Cited

U.S. PATENT DOCUMENTS

| | | | | | |
|---|---|---|---|---|---|
| 1,344,991 | A * | 6/1920 | Cunningham | F41A 3/26 | 89/154 |
| 1,386,247 | A * | 8/1921 | Fordyce | F41A 9/76 | 42/71.01 |
| 1,637,400 | A * | 8/1927 | Lovasz | F41A 5/02 | 89/169 |
| 1,709,399 | A * | 4/1929 | Herlach et al. | F41A 9/68 | 89/137 |
| 1,801,072 | A * | 4/1931 | Browning | F41A 35/02 | 89/169 |
| 1,801,073 | A * | 4/1931 | Browning | F41A 5/08 | 89/169 |
| 1,803,352 | A * | 5/1931 | Tansley | F41A 9/37 | 89/33.2 |
| 1,818,984 | A * | 8/1931 | Browning | F41A 3/32 | 89/169 |

(Continued)

*Primary Examiner* — Michael D David

(74) *Attorney, Agent, or Firm* — Ballard Spahr LLP

(57) ABSTRACT

A bullpup shotgun which ejects shells from the bottom of its action has a reciprocable cover which, when in a closed position, overlies the breech end of the shotgun's barrel. When in an open position, the cover is in spaced relation to the barrel breech end, allowing access to the shotgun's action to clear an ammunition feed malfunction. The cover is mounted on a butt stock, and is slidable or rotatable relatively to the shotgun's butt stock to effect motion of the cover between the open and closed positions.

9 Claims, 8 Drawing Sheets

(56) References Cited

U.S. PATENT DOCUMENTS 1,878,038 A * 9/1932 Frommer ..... F41A 35/02 42/16
1,907,164 A * 5/1933 White ..... F41A 17/56 89/184
1,911,494 A * 5/1933 Floyd ..... F41A 17/28 89/145
2,047,789 A * 7/1936 Loomis ..... F41A 17/56 42/41
2,196,852 A * 4/1940 Browning ..... F41A 3/32 89/184
2,391,756 A * 12/1945 Vesely ..... F41A 9/68 42/50
2,562,037 A * 7/1951 Humeston ..... F41A 9/18 42/21
2,637,247 A * 5/1953 Hester ..... F41A 19/16 42/75.03
2,970,398 A * 2/1961 Crouch ..... F41A 19/10 42/106
3,020,662 A * 2/1962 Merkel ..... F41A 19/39 42/69.01
3,075,511 A * 1/1963 Ryan ..... F41C 3/08 124/16
3,077,044 A * 2/1963 Reed ..... F41A 15/10 42/25
3,101,703 A * 8/1963 Ryan ..... F41C 3/08 124/39
3,233,546 A * 2/1966 Foote ..... F42B 7/06 102/451
3,399,481 A * 9/1968 Giorgini ..... F41A 9/72 42/87
3,512,290 A * 5/1970 La Violette, Jr. ..... F41A 3/66 D22/104
3,570,366 A * 3/1971 Nickel ..... F41A 9/18 89/138
3,611,869 A * 10/1971 Hupp ..... F41A 9/37 89/33.04
3,630,118 A * 12/1971 Stoner ..... F41A 3/26 89/13.05
3,731,588 A * 5/1973 Curtis ..... F41A 19/34 89/1.4
3,744,371 A * 7/1973 McFarland ..... F41A 9/37 89/33.04
3,766,825 A * 10/1973 Robinson ..... F41A 9/37 89/33.04
3,768,190 A * 10/1973 Ruger ..... F41A 17/46 42/59
3,810,326 A * 5/1974 Hillberg ..... F41C 3/14 42/62
3,999,461 A * 12/1976 Johnson ..... F41A 9/30 89/185
4,004,489 A * 1/1977 Johnson ..... F41A 9/37 89/33.04
4,022,105 A * 5/1977 White ..... F41A 3/26 89/181
4,069,740 A * 1/1978 Hottinger ..... F41A 9/64 89/33.17
4,119,012 A * 10/1978 Frye ..... F41A 9/37 89/33.04
4,223,589 A * 9/1980 Post ..... F41A 9/37 89/33.04
4,395,937 A * 8/1983 Ottolini ..... F41C 7/02 89/193
4,463,654 A * 8/1984 Barnes ..... F41A 19/09 42/74
4,562,659 A * 1/1986 Neta ..... F41A 35/06 42/71.01
4,601,123 A * 7/1986 Swearengen ..... F41A 11/02 42/74
4,635,530 A * 1/1987 Weldle ..... F41A 15/14 89/193
4,663,876 A * 5/1987 Reaume ..... F41C 23/16 42/72
4,677,781 A * 7/1987 Lee ..... F41A 17/22 42/72
4,709,617 A * 12/1987 Anderson ..... F41A 5/16 89/157
4,856,410 A * 8/1989 Anderson ..... F41C 7/02 89/155
4,867,039 A * 9/1989 Dobbins ..... F41C 7/02 89/146
4,869,008 A * 9/1989 Rasmussen ..... F41A 19/09 42/71.01
4,882,973 A * 11/1989 Piscetta ..... F41C 7/00 89/1.41
4,932,148 A * 6/1990 Barrett ..... F41A 19/10 89/14.3
4,944,109 A * 7/1990 Zedrosser ..... F41C 23/00 42/75.01
5,119,575 A * 6/1992 Gajdica ..... F41A 9/72 42/49.01
5,171,934 A * 12/1992 Moore ..... F42B 7/08 102/448
5,235,769 A * 8/1993 Stead ..... F41A 17/48 42/50
5,361,700 A * 11/1994 Carbone ..... F42B 7/10 102/513
5,367,810 A * 11/1994 Stead ..... F41A 9/72 89/33.04
5,675,110 A * 10/1997 Gyre ..... F41A 9/37 89/33.04
5,827,991 A * 10/1998 Predazzer ..... F41A 5/16 89/178
5,834,678 A * 11/1998 Kalb ..... F41A 3/46 89/14.3
6,135,005 A * 10/2000 Dobbins ..... F41A 3/60 89/33.04
6,481,144 B1 * 11/2002 Chee ..... F41A 17/00 89/14.05
6,779,461 B1 * 8/2004 Olson ..... F41A 15/00 102/439
6,860,207 B1 * 3/2005 Robertson ..... F42B 7/04 86/44
6,877,265 B2 * 4/2005 Hajjar ..... F41A 9/72 42/49.01
7,047,684 B2 * 5/2006 Roh ..... F41C 7/00 42/16
7,165,352 B2 * 1/2007 Langlotz ..... F41A 19/16 89/132
7,231,864 B2 * 6/2007 Ratti ..... F41A 5/20 89/159
7,356,958 B2 * 4/2008 Weir ..... F41C 23/16 42/42.02
7,448,307 B1 * 11/2008 Dafinov ..... F41A 5/26 89/191.01
7,451,706 B2 * 11/2008 Meyer ..... F41A 21/10 102/446
7,469,496 B1 * 12/2008 Kellgren ..... F41A 35/06 42/46
7,493,718 B2 * 2/2009 Gorzen ..... F41A 3/10 42/74
7,814,695 B1 * 10/2010 Keeney ..... F41A 3/66 42/71.01
7,966,762 B2 6/2011 Barrett
8,122,635 B2 * 2/2012 Pullicar ..... F41C 23/16 42/72
8,261,479 B2 9/2012 Barrett
8,353,123 B2 * 1/2013 Pullicar ..... F41C 23/22 42/71.01
8,615,915 B2 * 12/2013 Hunter ..... F41C 23/16 42/72
8,683,725 B2 * 4/2014 Munson ..... F41A 17/38 42/6
8,683,726 B1 * 4/2014 Genton ..... F41A 3/24 42/17
8,733,007 B2 * 5/2014 Hatfield ..... F41A 9/35 89/33.04
8,782,940 B1 * 7/2014 Morris ..... F41C 23/20 42/71.01

(56) References Cited

U.S. PATENT DOCUMENTS 8,806,788 B1 * 8/2014 Hu ..... F41A 17/38 42/6
8,819,976 B1 * 9/2014 Kellgren ..... F41A 9/17 42/6
8,826,577 B1 * 9/2014 Bentley ..... F41C 23/22 42/71.01
8,839,709 B1 * 9/2014 Crye ..... F41A 3/76 89/157
8,869,672 B2 * 10/2014 Smith ..... F41A 9/01 89/33.14
8,925,234 B1 1/2015 Barrett
8,931,393 B1 * 1/2015 Vincent ..... F41A 17/46 89/27.3
8,944,041 B2 * 2/2015 Hu ..... F41A 19/06 89/129.01
9,010,233 B2 * 4/2015 St. George ..... F41C 7/00 42/69.02
9,015,979 B2 * 4/2015 Safewright, Jr. ..... F41A 9/71 42/49.02
9,015,981 B2 * 4/2015 Zamlinsky ..... F41C 23/06 42/75.01
9,021,935 B1 * 5/2015 Kellgren ..... F41A 7/00 89/193
9,097,476 B2 * 8/2015 Mead ..... F41A 9/63
9,109,849 B2 * 8/2015 Young ..... F41A 15/16
9,115,954 B1 * 8/2015 Corsi ..... F41A 21/06
9,188,399 B1 11/2015 Findlay et al.
9,341,429 B1 * 5/2016 Reavis, III ..... F41A 35/02
9,347,725 B2 * 5/2016 McAlister ..... F41A 19/08
9,347,737 B2 * 5/2016 Troy ..... F41C 7/02
9,612,067 B2 * 4/2017 Boyarkin ..... F41C 23/04
9,958,230 B1 * 5/2018 Nugent ..... F41A 9/65
10,006,727 B2 * 6/2018 Barrett ..... F41C 23/20
10,041,754 B2 * 8/2018 Tamir ..... F41A 35/02
10,088,257 B2 * 10/2018 Popikov ..... F41A 9/15
10,145,631 B2 * 12/2018 Barrett ..... F41A 3/66
10,161,709 B1 * 12/2018 Wright ..... F41C 7/00
10,288,369 B2 * 5/2019 Albury ..... F41A 11/00
10,317,156 B2 * 6/2019 Shaver ..... F41C 23/04
10,345,074 B1 * 7/2019 Zamlinskiy ..... F41C 23/10
10,605,548 B1 3/2020 Lukofnak, III
D919,739 S 5/2021 Muska
11,022,386 B2 6/2021 Muska
D926,277 S 7/2021 Muska
D926,278 S 7/2021 Muska
D926,279 S 7/2021 Muska
D926,280 S 7/2021 Muska
2005/0235546 A1 * 10/2005 Wonisch ..... F41G 11/003 42/75.01
2006/0048425 A1 * 3/2006 Frickey ..... F41A 19/09 42/105
2007/0033850 A1 * 2/2007 Murello ..... F41C 23/16 42/71.01
2007/0151438 A1 * 7/2007 Courty ..... F41C 7/00 89/1.41
2008/0121096 A1 * 5/2008 Hajjar ..... F41A 9/74 89/14.3
2009/0211140 A1 * 8/2009 Rolfe ..... F41C 23/04 42/71.01
2010/0307042 A1 * 12/2010 Jarboe ..... F41C 23/16 42/2
2011/0209607 A1 * 9/2011 St. George ..... F41A 3/26 89/191.01
2011/0283584 A1 * 11/2011 Walters ..... F41C 23/14 42/73
2013/0185975 A1 * 7/2013 Johnson ..... F41A 19/08 29/401.1
2014/0075803 A1 * 3/2014 Muller ..... F41A 3/00 42/16
2014/0075812 A1 * 3/2014 Johnson ..... F41A 19/08 42/69.01
2014/0196345 A1 * 7/2014 Grimshaw ..... F41C 23/04 42/73
2015/0107143 A1 * 4/2015 Coetzee ..... F41G 11/003 42/14
2015/0316339 A1 * 11/2015 Young ..... F41A 9/61 42/49.01
2016/0000646 A1 * 1/2016 Scherkowski .... A61M 37/0076 601/108
2016/0153732 A1 * 6/2016 Geissele ..... B23H 9/00 42/69.01
2016/0187099 A1 * 6/2016 Cottle ..... F41C 23/14 42/73
2017/0205187 A1 * 7/2017 Brown ..... F41C 23/10
2018/0224233 A1 * 8/2018 Macy ..... F41C 23/12
2019/0128639 A1 * 5/2019 Parker ..... F41C 23/14
2019/0204034 A1 * 7/2019 Young ..... F41A 21/28
2020/0378709 A1 12/2020 Muska
2021/0025666 A1 1/2021 Muska
2021/0041208 A1 2/2021 Muska
2021/0048261 A1 2/2021 Muska
2021/0048262 A1 * 2/2021 Muska ..... F41A 15/12

* cited by examiner

FIREARM HAVING RECIPROCABLE BREECH COVER

CROSS REFERENCE TO RELATED APPLICATIONS

This application is a divisional of U.S. patent application Ser. No. 16/924,537, filed Jul. 9, 2020, which application is based upon and claims benefit of priority to U.S. Provisional Application No. 62/885,837, filed Aug. 13, 2019, both applications being hereby incorporated by reference herein.

FIELD OF THE INVENTION

This invention relates to firearms and features for providing access to the breech end the firearm's barrel.

BACKGROUND

A bottom ejection type shotgun features a spring biased, forked elevator that functions to both chamber and eject shells. The forked elevator spreads during the termination of travel of the bolt during the feeding cycle. Cam surfaces on the bolt pass the end of the elevator. The spring bias of the elevator assures compliant contact with the width of the bolt after it has "snapped over" the cams surfaces. The cam surfaces contact the ends of the elevator during the aft travel of the bolt (the ejection cycle), lifting the elevator to the ejection position.

In bottom ejection type shotguns, once fed onto the elevator, a shell must complete the chambering and ejection cycle in order to be removed from the gun. However, if the shell is damaged (due to manufacturing issues or during shotgun operation), and the nature of the damage is such that chambering cannot be accomplished, the shell will not be able to be removed, rendering the shotgun inoperative. (If the shell is resting on top of the elevator, it cannot be pulled through the elevator).

There is clearly a need to provide access to the breech of bottom ejection shotguns to ensure that ammunition feed malfunctions can be cleared quickly without the need to disassemble the weapon.

SUMMARY

The invention concerns a firearm. An example firearm according to the invention comprises a receiver. A barrel is mounted on the receiver. The barrel has a breech end. A butt stock is movably mounted on the receiver adjacent to the breech end of the barrel. A cover is mounted on the butt stock. A portion of the cover extends toward the breech end of the barrel. The butt stock is movable between a closed position, wherein the portion of the cover is positioned in overlying relation to the breech end of the barrel, and an open position, wherein the portion of the cover is positioned in spaced relation away from the breech end of the barrel, thereby exposing the breech end.

An example embodiment further comprises a guide rail mounted on the receiver proximate to the breech end of the barrel. The guide rail projects from the receiver toward the butt stock. The butt stock is slidably mounted on the guide rail. The butt stock defines a cavity for receiving the guide rail in sliding relationship. A slot is positioned in the guide rail and extends lengthwise therealong. A pin is mounted on the butt stock and extends transversely to the guide rail. The pin extends through the slot for limiting sliding motion of the butt stock along the guide rail.

An example firearm according to the invention may further comprise a latch mounted on the butt stock. The latch has a hook movable between an engaged position engaged with the receiver and thereby preventing motion of the butt stock relatively thereto, and a disengaged position not engaged with the receiver and thereby permitting motion of the butt stock relatively thereto. By way of example the hook engages the receiver via engagement with the guide rail. In another example embodiment the latch comprises a rotation axis affixed to the butt stock. The rotation axis is oriented transversely to the guide rail. A first leg extends from the rotation axis. The hook is mounted on the first leg distal to the rotation axis. A second leg extends from the rotation axis. A spring acts between the butt stock and the second leg for biasing the hook into the engaged position. A button is movably mounted on the butt stock. The button comprises an action surface engageable with the second leg of the latch and a contact surface for manual manipulation of the button. A return spring acts between the button and the butt stock for biasing the contact surface away from the second leg. Further by way of example, the button is slidably movable relatively to the butt stock.

By way of example, the firearm according to the invention may comprise a shotgun having a bullpup configuration. An ammunition elevator may be mounted on the butt stock.

Another example firearm according to the invention may comprise a receiver. A barrel is mounted on the receiver. The barrel has a breech end. A butt stock is mounted on the receiver adjacent to the breech end of the barrel. A cover is mounted on the butt stock. A portion of the cover extends toward the breech end of the barrel. The cover is movable between a closed position wherein the portion of the cover is positioned in overlying relation to the breech end of the barrel, and an open position wherein the portion of the cover is positioned in spaced relation away from the breech end of the barrel, thereby exposing the breech end.

A further example of a firearm according to the invention comprises a guide rail mounted on the receiver proximate to the breech end of the barrel. The guide rail projects from the receiver toward the butt stock. The butt stock is slidably mounted on the guide rail. By way of example the butt stock defines a cavity for receiving the guide rail in sliding relationship. In this example a slot is positioned in the guide rail and extending lengthwise therealong. A pin is mounted on the butt stock and extending transversely to the guide rail. The pin extends through the slot for limiting sliding motion of the butt stock along the guide rail. An example embodiment may further comprise a latch mounted on the butt stock. The latch has a hook movable between an engaged position engaged with the receiver and thereby preventing motion of the butt stock relatively thereto, and a disengaged position not engaged with the receiver and thereby permitting motion of the butt stock relatively thereto. The hook engages the receiver via engagement with the guide rail in this example.

In an example embodiment the latch comprises a rotation axis affixed to the butt stock. The rotation axis is oriented transversely to the guide rail. A first leg extends from the rotation axis. The hook is mounted on the first leg distal to the rotation axis. A second leg extends from the rotation axis. A spring acts between the butt stock and the second leg for biasing the hook into the engaged position. Further by way of example, a button is movably mounted on the butt stock. The button comprises an action surface engageable with the second leg of the latch and a contact surface for manual manipulation of the button. A return spring acts between the button and the butt stock for biasing the contact surface away from the second leg. In an example embodiment the button is slidably movable relatively to the butt stock.

An example firearm according to the invention may comprise a shotgun having a bullpup configuration. Such an example may comprise an ammunition elevator mounted on the butt stock.

A further example firearm may comprise a hinge connecting the cover to the butt stock. The hinge defines an axis of rotation. The cover is rotatable about the axis between the closed position and the open position. An example may further comprise a spring acting between the butt stock and the cover for biasing the cover into the open opposition. A latch is mounted on the firearm. The latch engages the cover for holding the cover in the closed position. By way of example the latch is mounted on the receiver. In a further example the cover is slidably mounted on the butt stock. The cover is slidably movable relatively to the butt stock between the open and the closed positions. An example embodiment further comprises a cam track mounted on either the butt stock or the cover. The cam track extends in a direction defining sliding motion of the cover relatively to the butt stock. A cam follower is mounted on either the butt stock or the cover. The cam follower engages the cam track and guides the sliding motion of the cover between the open and the closed positions.

The invention also encompasses a method of clearing an ammunition feed malfunction of a firearm having a butt stock engaged with a receiver. A barrel is mounted on the receiver. The barrel has a breech end. In an example embodiment the method comprises:

- moving the butt stock out of engagement with the receiver thereby exposing the breech end of the barrel;
- removing ammunition from the receiver proximate to the breech end of the barrel;
- moving the butt stock back into engagement with the receiver.

DETAILED DESCRIPTION

Figure 1:
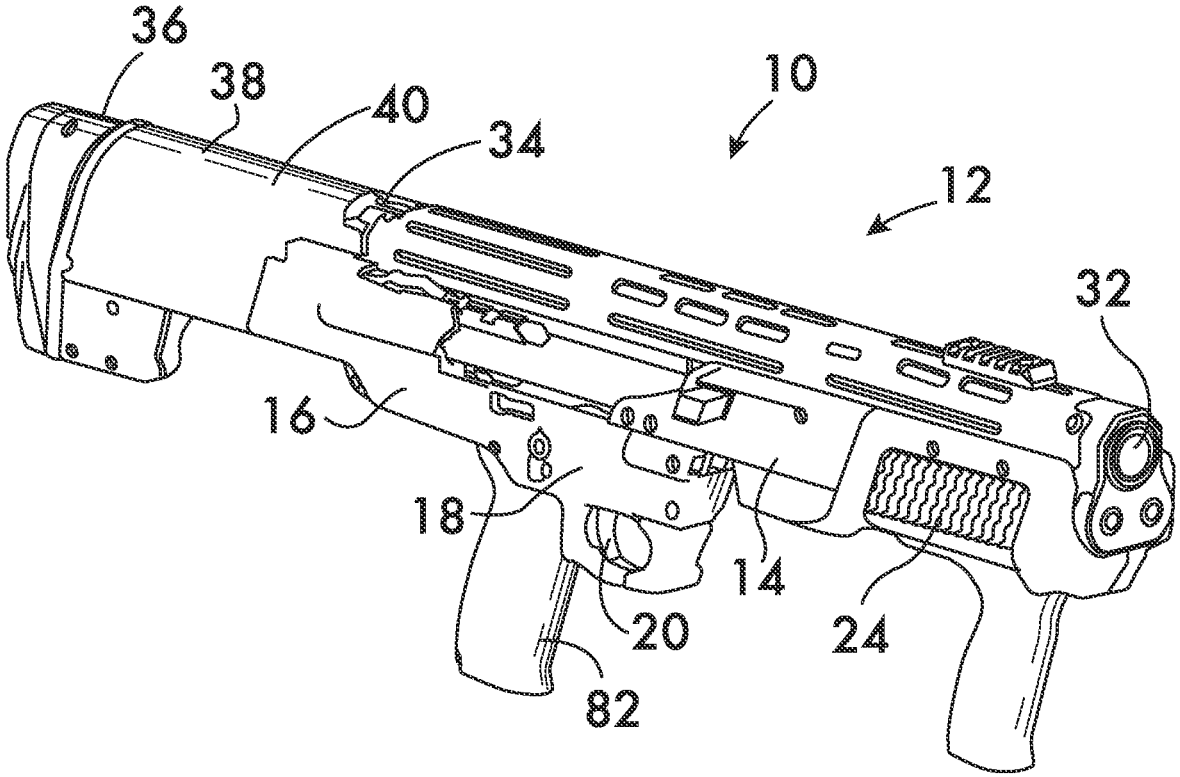
FIG. 1 is an isometric view of an example shotgun having a reciprocal breech cover according to the invention.
Figure 2:
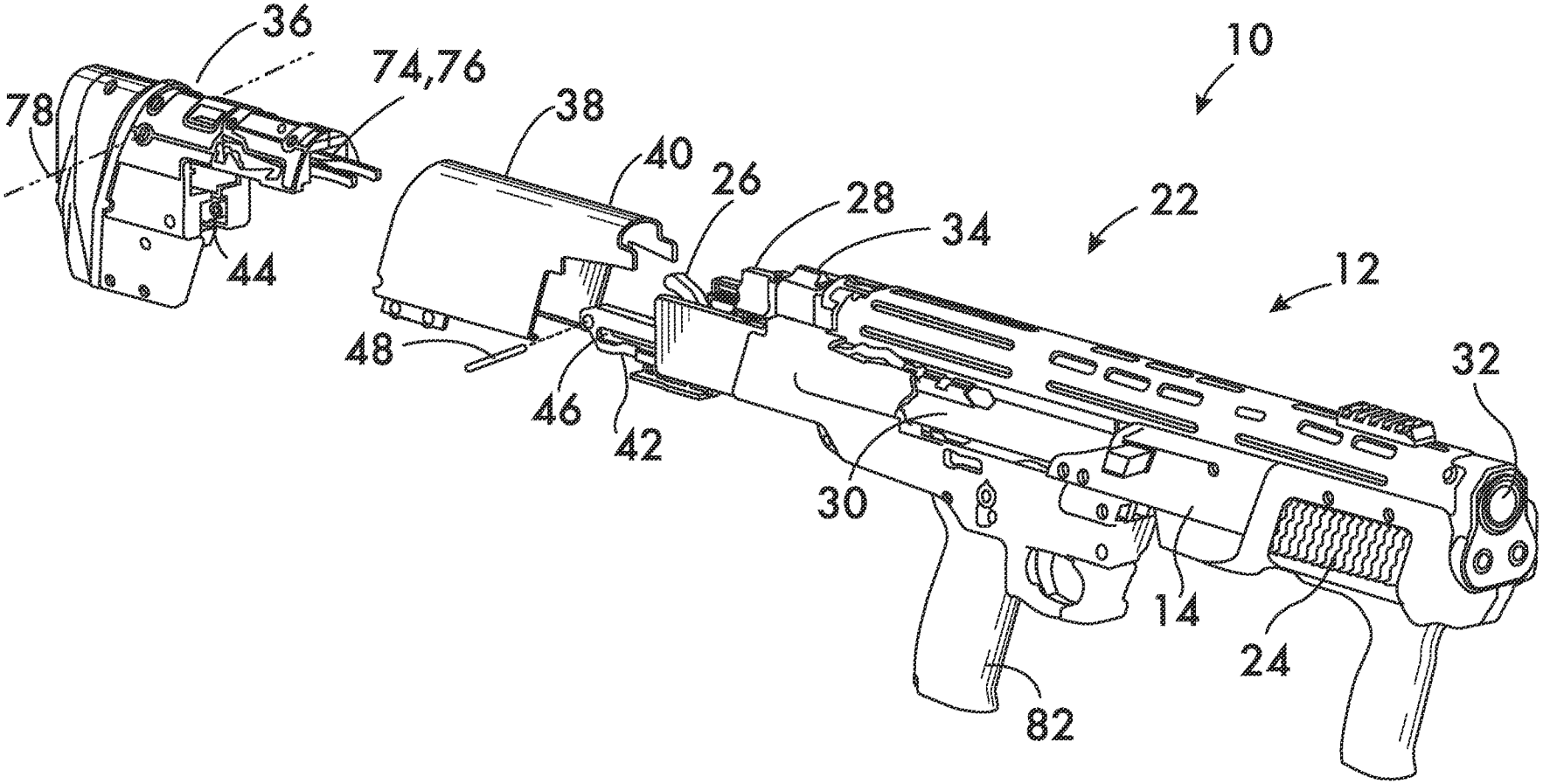
FIG. 2 is an exploded isometric view of the shotgun shown in FIG. 1.
Figure 4:
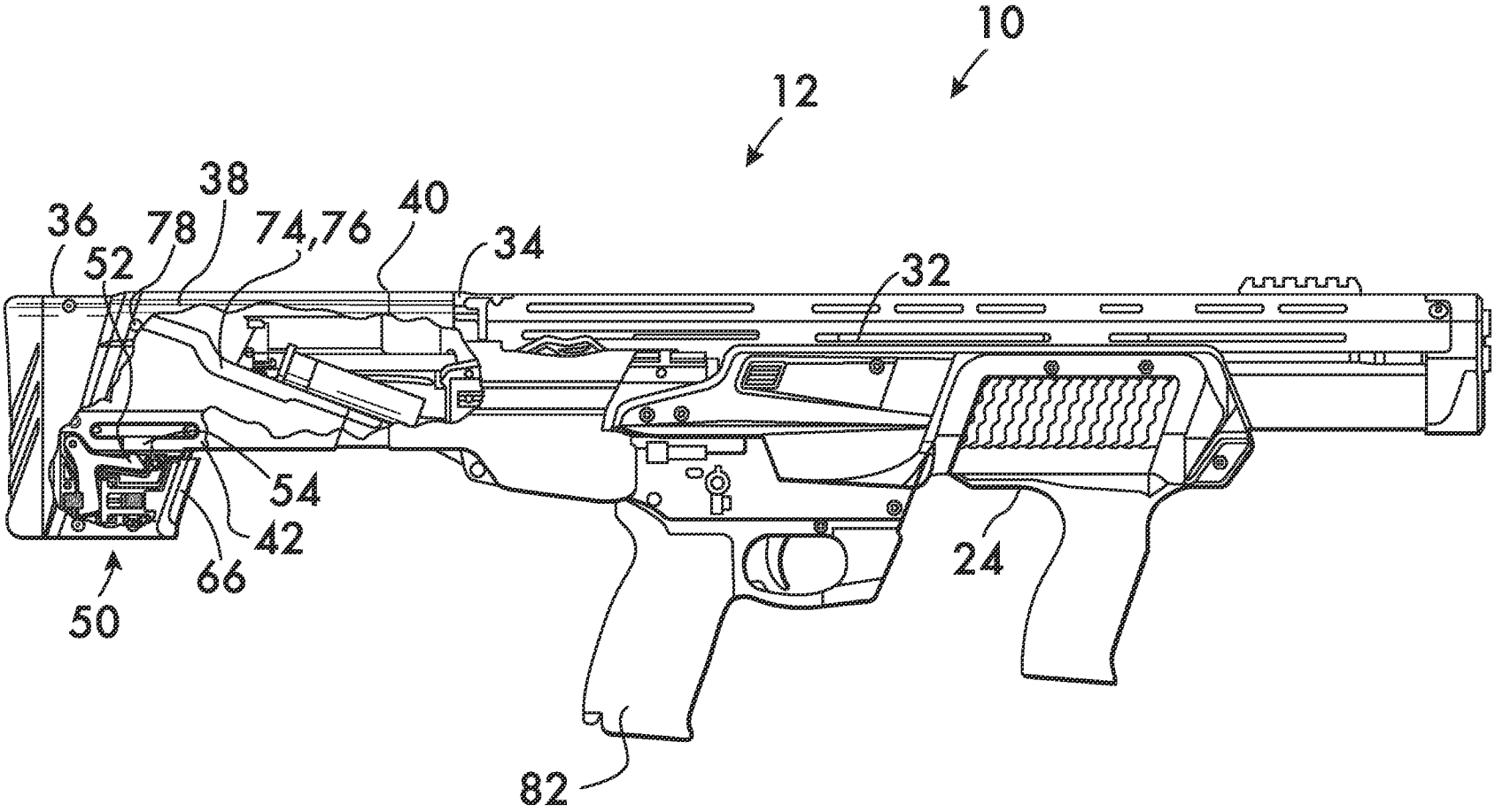
FIG. 4 is a partial cut-away view illustrating an ammunition feed malfunction in the shotgun shown in FIG. 1.

FIG. 1 shows a firearm, in this example, a self-defense shotgun 10 having a bullpup configuration. Example shotgun 10 comprises a receiver 12 which includes an upper receiver 14 and a lower receiver 16. Lower receiver 16 houses the fire control group 18 including a trigger 20 and its associated mechanisms (not shown). As shown in FIG. 2, upper receiver 14 houses the firearm's action 22, in this example a pump action, represented by the movable fore-end 24, hammer 26 and breech bolt 28. Also mounted on the upper receiver 14 are tubular ammunition magazines 30 and a barrel 32 beneath a barrel shroud 34 vented for cooling. Barrel 32 has a breech end 34 which is engaged by the breech bolt 28 as the shotgun is cycled out of and into battery when the fore-end 24 is moved toward and away from the breech end 34 as shown in FIG. 4.

FIGS. 1 and 2 also show a butt stock 36, in this example embodiment, movably mounted on the receiver 12 adjacent to the breech end 34 of the barrel 32. A cover 38 is mounted on the butt stock 36. A portion 40 of the cover 38 extends toward the breech end 34 of the barrel 32. As shown in a comparison of FIGS. 4 and 5, the butt stock 36 is movable between a closed position (FIG. 4) wherein the portion 40 of cover 38 is positioned in overlying relation to the breech end 34 of the barrel 32, and an open position (FIG. 5) wherein the portion 40 of cover 38 is positioned in spaced relation away from the breech end 34 of the barrel 32, thereby exposing the breech end.

Figure 3:
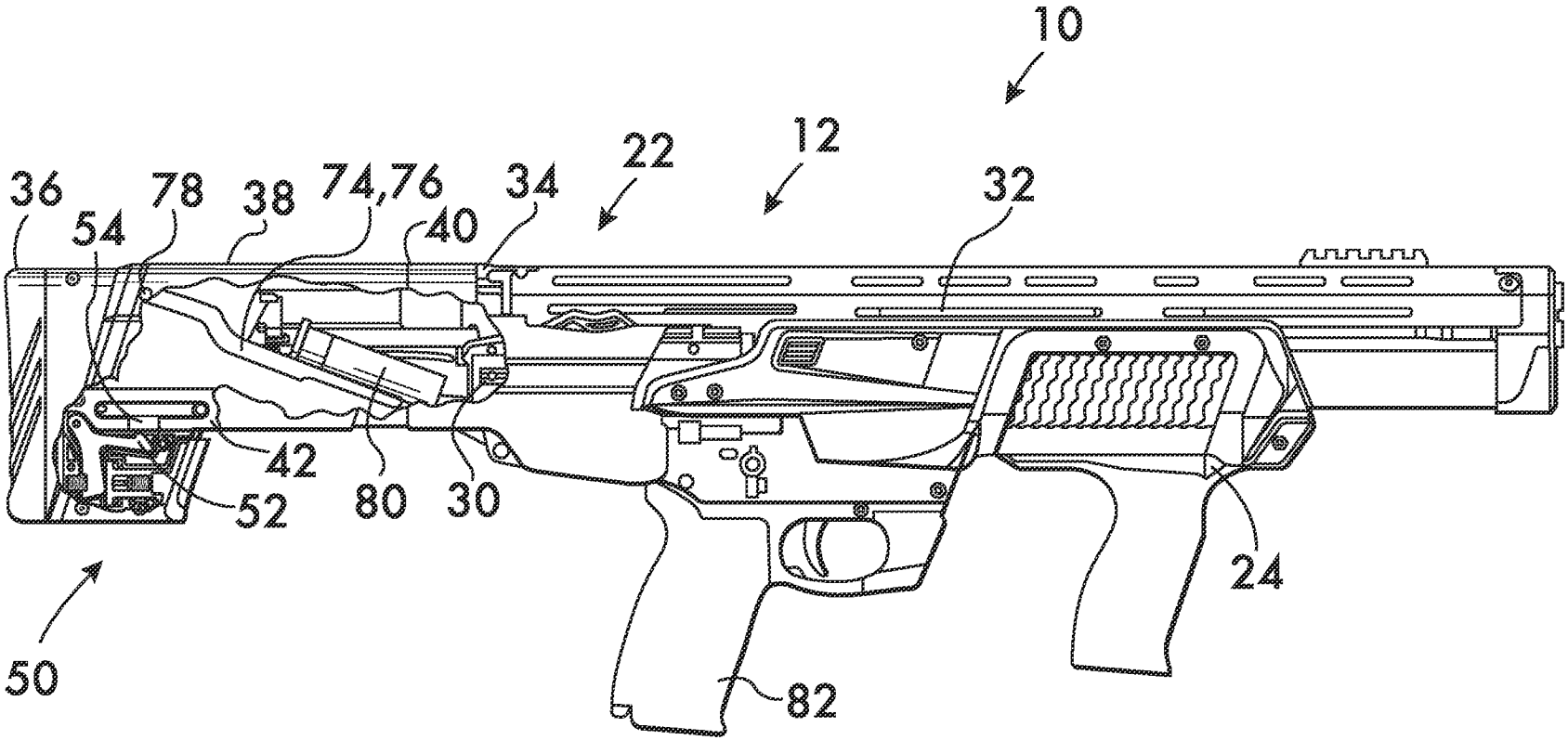
FIG. 3 is a partial cut-away view illustrating an ammunition feed malfunction in the shotgun shown in FIG. 1.

As shown in FIG. 2, motion of the butt stock 36 is enabled by mounting it on a guide rail 42. Guide rail 42 is mounted on the receiver 12 proximate to the breech end 34 of the barrel 32. The guide rail 42 projects from the receiver 12 toward the butt stock 36, and the butt stock is slidably mounted on the guide rail. The butt stock 36 defines a cavity 44 for receiving the guide rail 42 in sliding relationship. A slot 46 is positioned in the guide rail 42 and extends lengthwise along it. A retaining pin 48 is mounted on the butt stock and extends transversely to the guide rail 42. Pin 48 extends through the slot 46 and limits sliding motion of the butt stock 36 along the guide rail 42. The pin and slot combination also retains the butt stock 36 to the receiver 12. As shown in FIGS. 3 and 4, the butt stock 36 is held in the closed position by a latch 50 mounted on the butt stock. In this example embodiment, the latch has a hook 52 movable between an engaged position (FIG. 3) engaged with the receiver 12, and a disengaged position (FIG. 4) not engaged with the receiver. When hook 52 is in the engaged position, motion of the butt stock 36 relatively to the receiver is prevented, and when the hook is in the disengaged position, motion of the butt stock relatively to the receiver is permitted. In this example embodiment the hook 52 engages the receiver indirectly via engagement with an opening 54 in the guide rail 42.

Figure 4A:
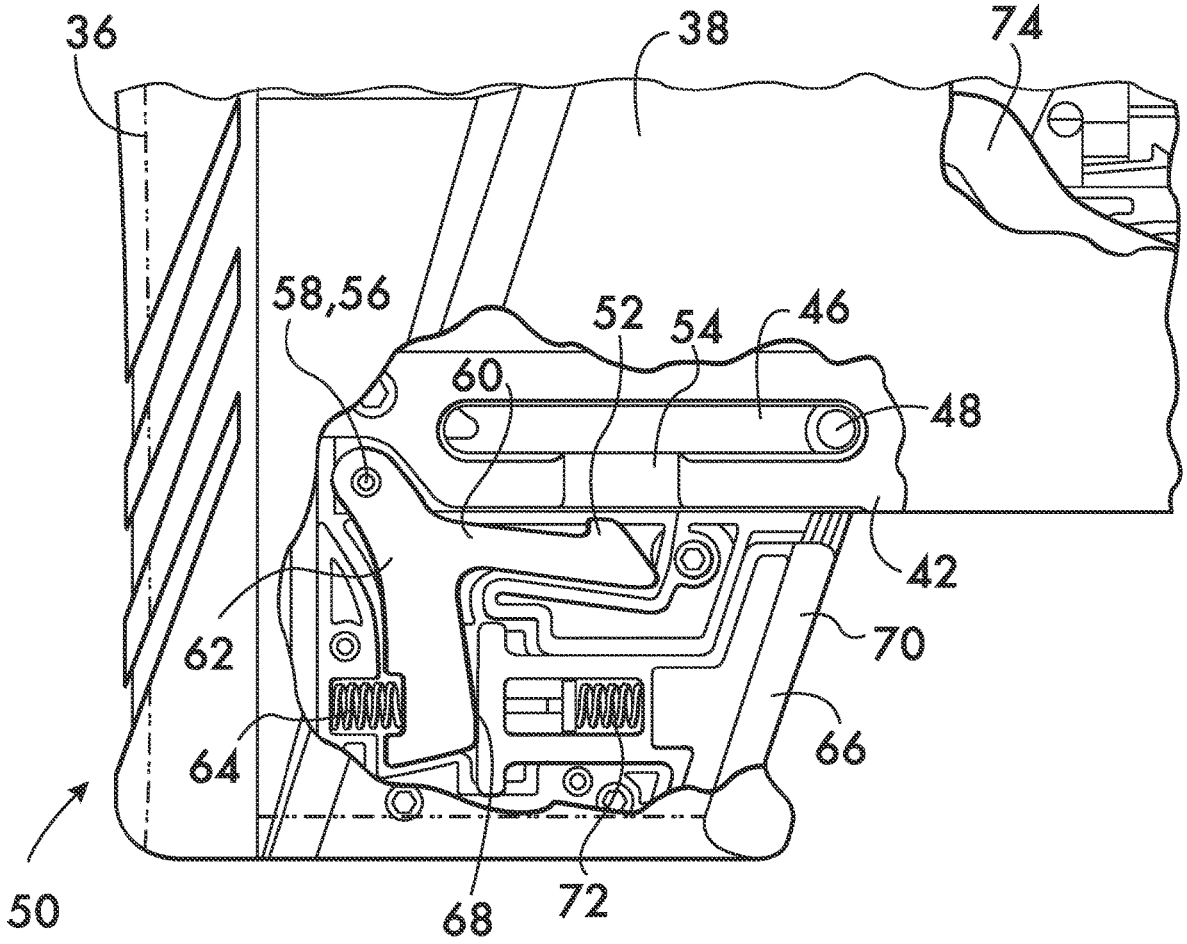
FIG. 4A is a partial cut-away view of a portion of the shotgun shown in FIG. 4 on an enlarged scale.

An example latch 50 is shown in detail in FIG. 4A. The example latch comprises a rotation axis 56 defined by a pin 58 affixed to the butt stock 36. The rotation axis 56 is oriented transversely to the guide rail 42. A first leg 60 extends from the rotation axis 56. The hook 52 is mounted on the first leg 60 distal to the rotation axis 56. A second leg 62 also extends from the rotation axis 56. A spring 64 acts between the butt stock 36 and the second leg 62 for biasing the hook 52 into the engaged position shown in FIG. 3. Latch 50 also comprises a button 66 movably mounted on the butt stock 36. As shown in FIG. 4A, button 66 comprises an action surface 68 engageable with the second leg 62, and a contact surface 70, for manual manipulation of the button. A return spring 72 acts between the button 66 and the butt stock 36 for biasing the contact surface 70 away from the second leg 62. In this example embodiment the button 66 is slidably movable relatively to the butt stock 36.

As shown in FIG. 2, an ammunition elevator 74 is also mounted on the butt stock 36. In this example embodiment, the ammunition elevator 74 comprises a fork 76 which pivots about a pivot axis 78 oriented transversely to the guide rail 42. The pivoting motion of fork 76 is controlled by the shotgun's action 22 and presents ammunition released from the magazines 30 to the breech end 34 of barrel 32 as described below.

If a bullpup shotgun is to be compatible with ambidextrous use then ejection of a spent shell is advantageously from the bottom of the firearm, as in the example shotgun 10. However, a complication arises with bottom ejecting shotguns if there is an ammunition misfeed. The misfeeding shell is typically above the elevator and therefore is almost impossible to clear from the action, as the elevator blocks any such attempt. It would be advantageous to be able to easily remove a shell which does not chamber or does not chamber properly, and to that end the example shotgun 10 disclosed herein features the reciprocable cover 38 mounted on the butt stock 36.

Figure 5:
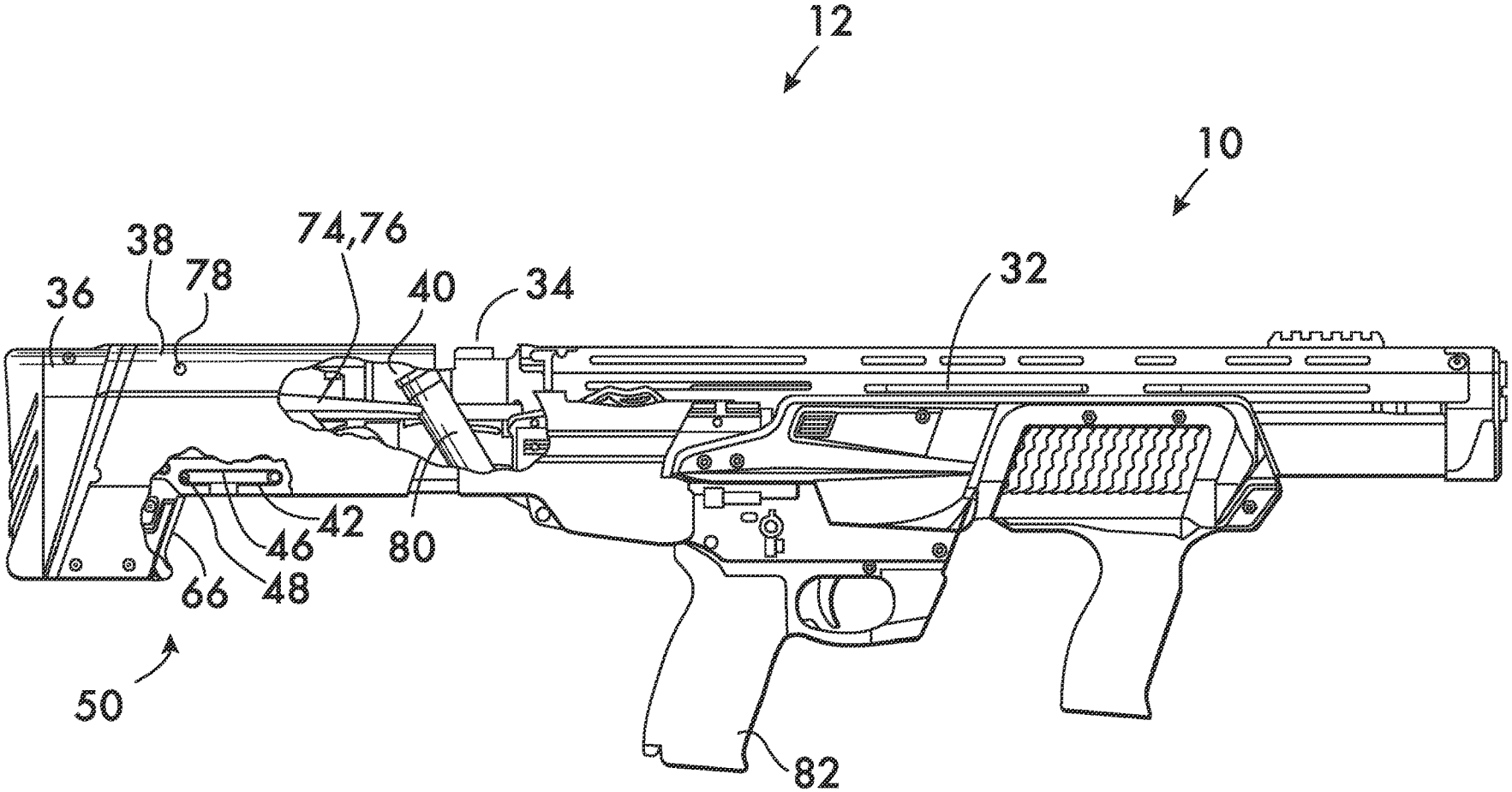
FIG. 5 is a partial cut-away view of the shotgun shown in FIG. 1 with the breech cover in an open position.

Operation of the reciprocable cover 38 is described with reference to FIGS. 3, 4 and 5. As shown in FIG. 3, the fore-end 24 has been pulled toward the breech end 34 of barrel 32. This fore-end motion pivots the elevator fork 76 clockwise about its pivot axis 78 and also releases a shell 80 from the ammunition magazine 30 onto the pivoted fork. The user then attempts to chamber the shell 80 by pushing the fore-end 24 away from the breech end 34 and place the action back into battery. This fore-end motion will pivot the fork counterclockwise allowing the shell to be presented for chambering. However, shell 80 will not chamber, for example, because the hull of the shell is bulged due to an improper crimp. The fore-end 24 cannot be pushed away from the breech end 34 to force the action 22 back into battery, nor can the misfed shell 80 be ejected by cycling the fore-end again. However, the misfed shell 80 may be cleared by moving the butt stock 36 out of engagement with the receiver 12, which also moves cover 38 and elevator 74, and thereby exposes the breech end 34 of the barrel 32. As shown in FIGS. 4 and 4A, with the "weak hand" still on the fore-end 24, the button 66 is depressed using the "strong hand" formerly holding the pistol grip 82. Force applied to the contact surface 70 of the button 66 causes the action surface 68 to engage the second leg 62 of latch 50 and pivot it clockwise about rotation axis 56. This also causes the first leg 60 to pivot about rotation axis 56 and thereby disengage hook 52 from opening 54 in the guide rail 42. With the hook 52 disengaged, the butt stock 36 and, consequently, cover 38 and elevator 74, are now free to move along guide rail 42. As shown in FIG. 5, the strong hand pulls the butt stock 36 away from the receiver 12, the motion of the butt stock being halted by engagement between the retaining pin 48 and the end of slot 46 in guide rail 42. The butt stock 36 is thus moved from the closed position (FIG. 4), wherein the cover portion 40 is in overlying relation to the breech end 34 of the barrel 32, to the open position (FIG. 5), wherein the portion 40 of cover 38 is positioned in spaced relation away from the breech end 34 of the barrel 32. The breech end 34 is now exposed and accessible, allowing the misfed ammunition (shell 80) to be manually removed from the receiver 12 proximate to the breech end 34 of the barrel 32 using the strong hand. Once the shell 80 has been removed the butt stock 36 is moved back into engagement with the receiver 12 (FIG. 3), the spring biased hook 52 again engaging opening 54 in guide rail 42 and securing the butt stock and cover 38 to the receiver 12.

Figure 6:
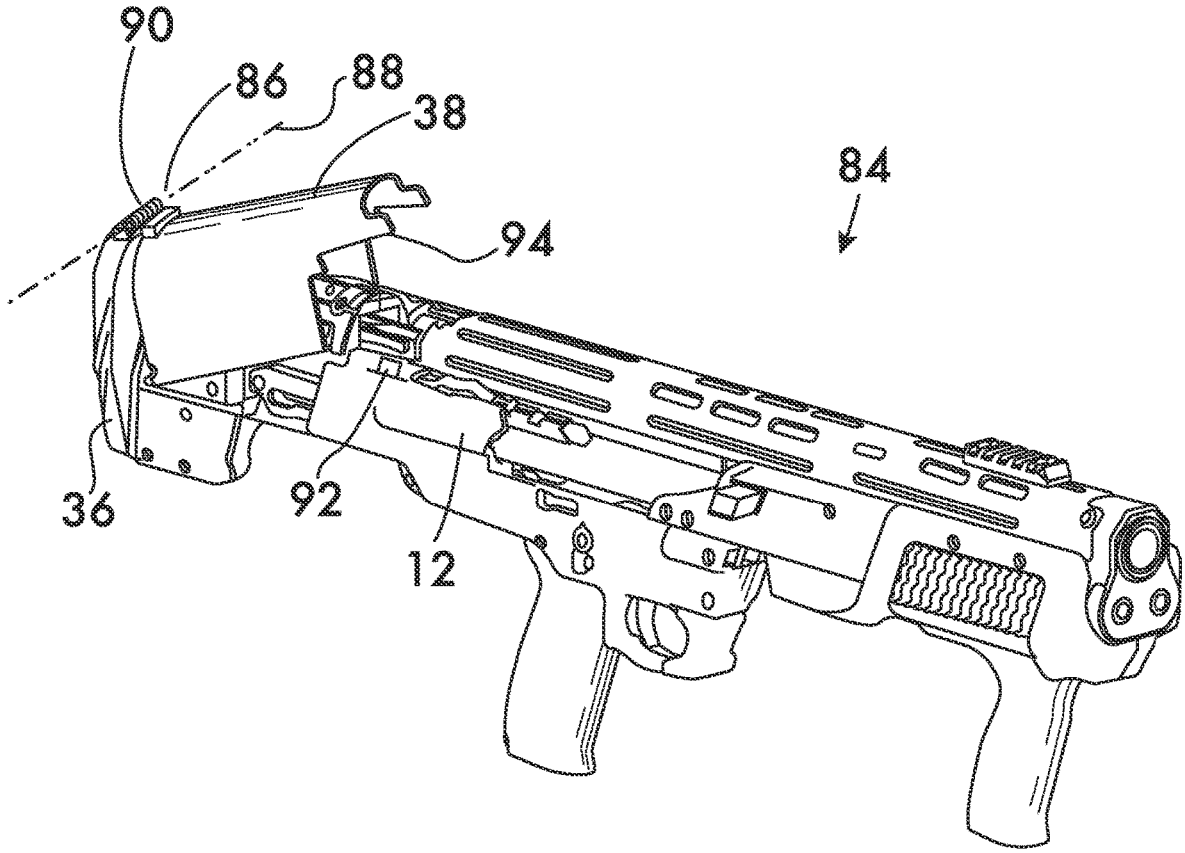
FIG. 6 is an isometric view of another example embodiment of a shotgun according to the invention.

FIG. 6 shows another example embodiment of a firearm, again, a bullpup shotgun 84 according to the invention. Shotgun 84 comprises a hinge 86 connecting the cover 38 to the butt stock 36. Hinge 86 defines an axis of rotation 88 about which the cover 38 rotates between the closed position and the open position (shown). It is advantageous to bias the cover 38 into the open opposition using a spring 90 acting between the butt stock and the cover. A latch 92, mounted on the firearm 84, engages the cover for holding the cover in the closed position. In this example embodiment the latch 92 is mounted on the receiver 12 and engages a tab 94 projecting from the cover 38.

Figure 7:
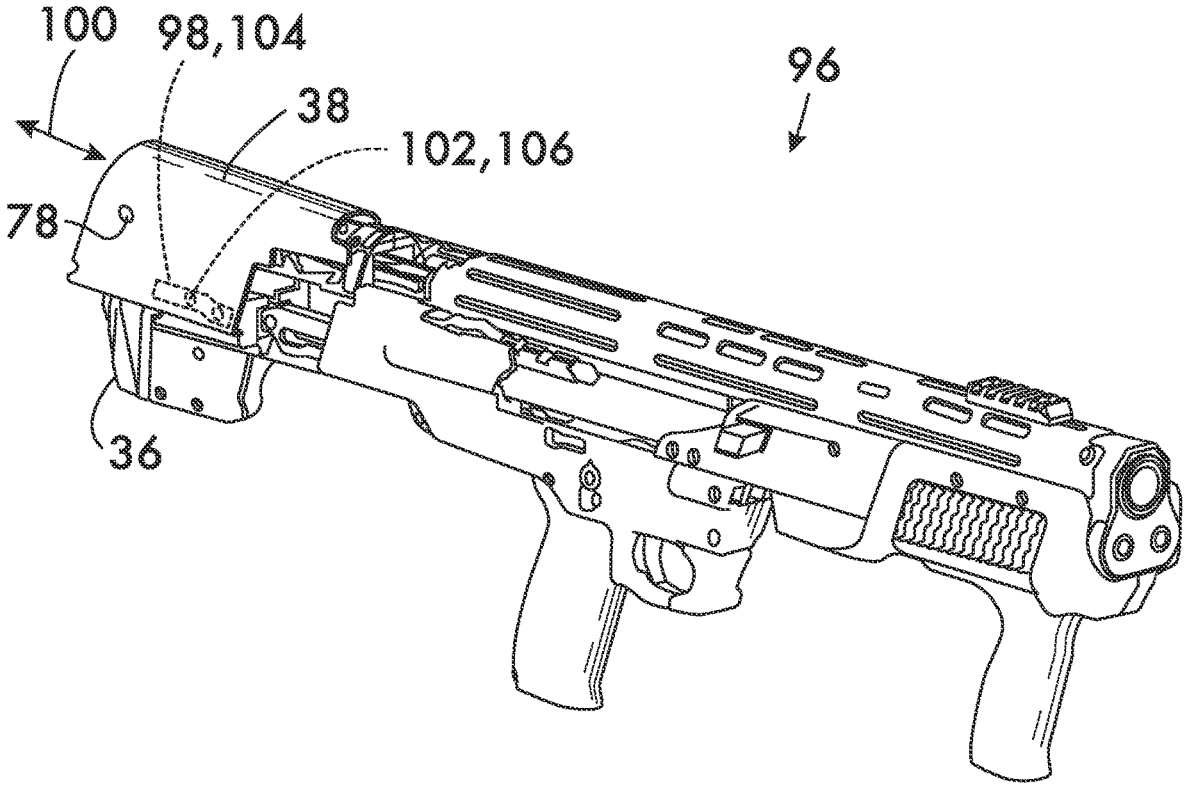
FIG. 7 is an isometric view of another example embodiment of a shotgun according to the invention.

Another example firearm embodiment 96 is shown in FIG. 7 wherein the cover 38 is slidably mounted on the butt stock 36. The cover 38 is slidably movable relatively to the butt stock 36 between the open (shown) and the closed positions. In this example embodiment, a cam track 98 is mounted on either the butt stock 36 or the cover 38. The cam track extends in a direction shown by arrow 100 which defines the sliding motion of the cover 38 relatively to the butt stock 36. One or more cam followers 102 are also mounted on either the butt stock 36 or the cover 38, the cam followers 102 engaging the cam track 98 which guides the sliding motion of the cover between the open and the closed positions. In this example the cam track 98 comprises a groove 104 recessed within the butt stock 36 and the cam followers comprise pins 106 mounted on the cover 38 and projecting into the groove 104. It is advantageous to duplicate the cam track and cam follower arrangement on the opposite side of cover 38 to provide controlled motion of the cover 38 between the open and closed positions.

Shotguns having reciprocable breech covers according to the invention are expected to improve the operation and reliability of such weapons.

What is claimed is:

1. A firearm, said firearm comprising:

a receiver;

a barrel mounted on said receiver, said barrel having a breech end;

a butt stock mounted on said receiver adjacent to said breech end of said barrel;

a cover mounted on said butt stock, a portion of said cover extending toward said breech end of said barrel;

a hinge connecting said cover to said butt stock, said hinge defining an axis of rotation;

wherein said cover is movable between a closed position wherein said portion of said cover is positioned in overlying relation to said breech end of said barrel, and an open position wherein said portion of said cover is positioned in spaced relation away from said breech end of said barrel, thereby exposing said breech end, said cover being rotatable about said axis between said closed position and said open position.

2. The firearm according to claim 1, wherein said firearm comprises a shotgun having a bullpup configuration.

3. The firearm according to claim 1, further comprising an ammunition elevator mounted on said butt stock.

4. The firearm according to claim 1, further comprising:

a spring acting between said butt stock and said cover for biasing said cover into said open position;

a latch mounted on said firearm, said latch engaging said cover for holding said cover in said closed position.

5. The firearm according to claim 4, wherein said latch is mounted on said receiver.

6. A firearm, said firearm comprising:

a receiver;

a barrel mounted on said receiver, said barrel having a breech end;

a butt stock mounted on said receiver adjacent to said breech end of said barrel;

a cover mounted on said butt stock, said cover being slidably movable relatively to said butt stock, a portion of said cover extending toward said breech end of said barrel;

wherein said cover is slidably movable between a closed position wherein said portion of said cover is positioned in overlying relation to said breech end of said barrel, and an open position wherein said portion of said cover is positioned in spaced relation away from said breech end of said barrel, thereby exposing said breech end.

7. The firearm according to claim 6, further comprising:

a cam track mounted on either said butt stock or said cover, said cam track extending in a direction defining sliding motion of said cover relatively to said butt stock;

a cam follower mounted on either said butt stock or said cover, said cam follower engaging said cam track and guiding said sliding motion of said cover between said open and said closed positions.

8. The firearm according to claim 6, wherein said firearm comprises a shotgun having a bullpup configuration.

9. The firearm according to claim 6, further comprising an ammunition elevator mounted on said butt stock.

* * * * *